US006668421B1

(12) United States Patent
Song

(10) Patent No.: US 6,668,421 B1
(45) Date of Patent: Dec. 30, 2003

(54) MOTOR BRUSH DUST REMOVING FILTER FOR USE IN VACUUM CLEANER

(75) Inventor: Seoung-Wook Song, Seoul (KR)

(73) Assignee: Conet Industry Inc., Seoul (KR)

( * ) Notice: Subject to any disclaimer, the term of this patent is extended or adjusted under 35 U.S.C. 154(b) by 0 days.

(21) Appl. No.: 09/474,513

(22) Filed: Dec. 29, 1999

(30) Foreign Application Priority Data

Oct. 15, 1999 (KR) ..... 1999-22208 U

(51) Int. Cl.[7] ..... A47L 5/00; A47L 7/00
(52) U.S. Cl. ..... 15/413; 15/412
(58) Field of Search ..... 15/412, 413

(56) References Cited

U.S. PATENT DOCUMENTS 5,027,469 A * 7/1991 Toyoshima et al. ..... 15/347 X

* cited by examiner

*Primary Examiner*—Terrence R. Till
(74) *Attorney, Agent, or Firm*—R. Neil Sudol; Henry Coleman; William Sapone

(57) ABSTRACT

A motor brush dust removing filter for use in a vacuum cleaner in which the vacuum cleaner includes a cylinder-shaped canister, a supporting portion having wheels and attached to a lower portion of the canister, an air outlet formed in a cover so as to discharge air at an upper portion of the cylindrical canister, and a vacuum generating unit for sucking air into the cylindrical canister. The cover has at a center thereof a circular aperture, a circular protrusion or shelf along the aperture, a filter, and a brush dust removing filter having a connection portion. The connection portion of the filter is fastened to a case of a motor brush assembly so that brush dust discharged via an air vent in an upper surface of the brush assembly case is filtered by the filter of the filter unit from air exhausted to the ambient atmosphere.

9 Claims, 5 Drawing Sheets

MOTOR BRUSH DUST REMOVING FILTER FOR USE IN VACUUM CLEANER

BACKGROUND OF THE INVENTION

1. Field of the Invention

The present invention relates to a motor brush dust removing filter for use in a vacuum cleaner, and more particularly, to a motor brush dust filter for a vacuum cleaner in which brush dust from a brush assembly of an electric motor employed to generate suction power of the vacuum cleaner is prevented from being discharged.

2. Description of the Conventional Art

A typical vacuum cleaner, as shown in FIG. 1, includes a cylindrical canister 10, a supporting member 11 having wheels 11*a* at a lower portion of cylindrical canister 10, an air outlet 12*a* for discharging air at an upper portion of cylindrical canister 10, and a vacuum generating unit 13 for sucking air into cylindrical canister 10.

Vacuum generating unit 13 is made up of a vacuum chamber 13*a*, a filter 13*b*, an air suction fan 13*c* arranged on suction filter 13*b*, and a motor 14 for driving air suction fan 13*c*.

When an electric motor 14 is driven by power supplied thereto by a user, air suction fan 13*c* rotates so as to generate in a space of suction filter 13*b*, i.e., vacuum chamber 13*a*, a vacuum state. Then, debris is sucked in via a hose 13*d* by the suction force of vacuum chamber 13*a*.

Thus, sucked-in substances are filtered by filter 13*b*, and the air passed through filter 13*b* is discharged outside via air outlet 12*a*.

Electric motor 14 employed for a rotation of air suction fan 13*c* is a common electric motor which uses a brush assembly 14*a* to provide a rotator with power. It is a common practice to place brush assembly 14*a* onto electric motor 14, wherein brush assembly 14*a* has at top surface thereof an air vent 14*b* so that a heat generated from the friction of the brush may be cooled down and a brush dust may be discharged.

To prevent the brush dust generated by the operation of brush assembly 14*a* of motor 14 from being discharged out via air outlet 12*a*, a conventional solution places a cover 15 having a non-woven fabric or a sponge 15*a* attached thereto over air vent 14*b*, so that the brush dust can be roughly collected and caught by a non-woven fabric or a sponge 2*c* which is attached inside air outlet 12*a*.

However, such a conventional brush dust collecting unit has disadvantages in that brush dust may not be completely blocked since cover 15 cannot be placed closely to air vent 14*b* considering cooling of inner heat generated by the operation of electric motor 4.

SUMMARY OF THE INVENTION

Therefore, it is an object of the present invention to provide a motor brush dust removing filter for use in a vacuum cleaner in which the brush dust from a brush assembly of an electric motor may be discharged via an additional outlet and a filter is embedded in or attached to the outlet, to thereby allow an efficient cooling of the brush assembly and a complete blocking of the brush dust.

To accomplish the above object of the present invention, there is provided a motor brush dust removing filter for use in a vacuum cleaner, the vacuum cleaner including a cylindrical canister, a support member having wheels installed under the canister, an air outlet in a cover for discharging air from an upper portion of the canister, and a vacuum generating unit containing an electric motor for sucking air into the canister, wherein the cover has at a center thereof a circular aperture, a circular protrusion along the aperture, a filtering member, and a brush dust removing filter having a connection portion attached to a case of the motor brush assembly, so that brush dust discharged via an air vent formed at an upper surface of the brush assembly case is filtered by the filter of the filter unit and directly exhausted to the atmosphere.

BRIEF DESCRIPTION OF THE DRAWINGS

The present invention will become more fully understood from the detailed description provided hereinafter with reference to the accompanying drawings, which are set forth by way of illustration only, and thus are not considered limitative of the present invention, and wherein.

PREFERRED EMBODIMENTS OF THE PRESENT INVENTION

The present invention will be explained more detail with reference to the attached drawings.

Figure 1:
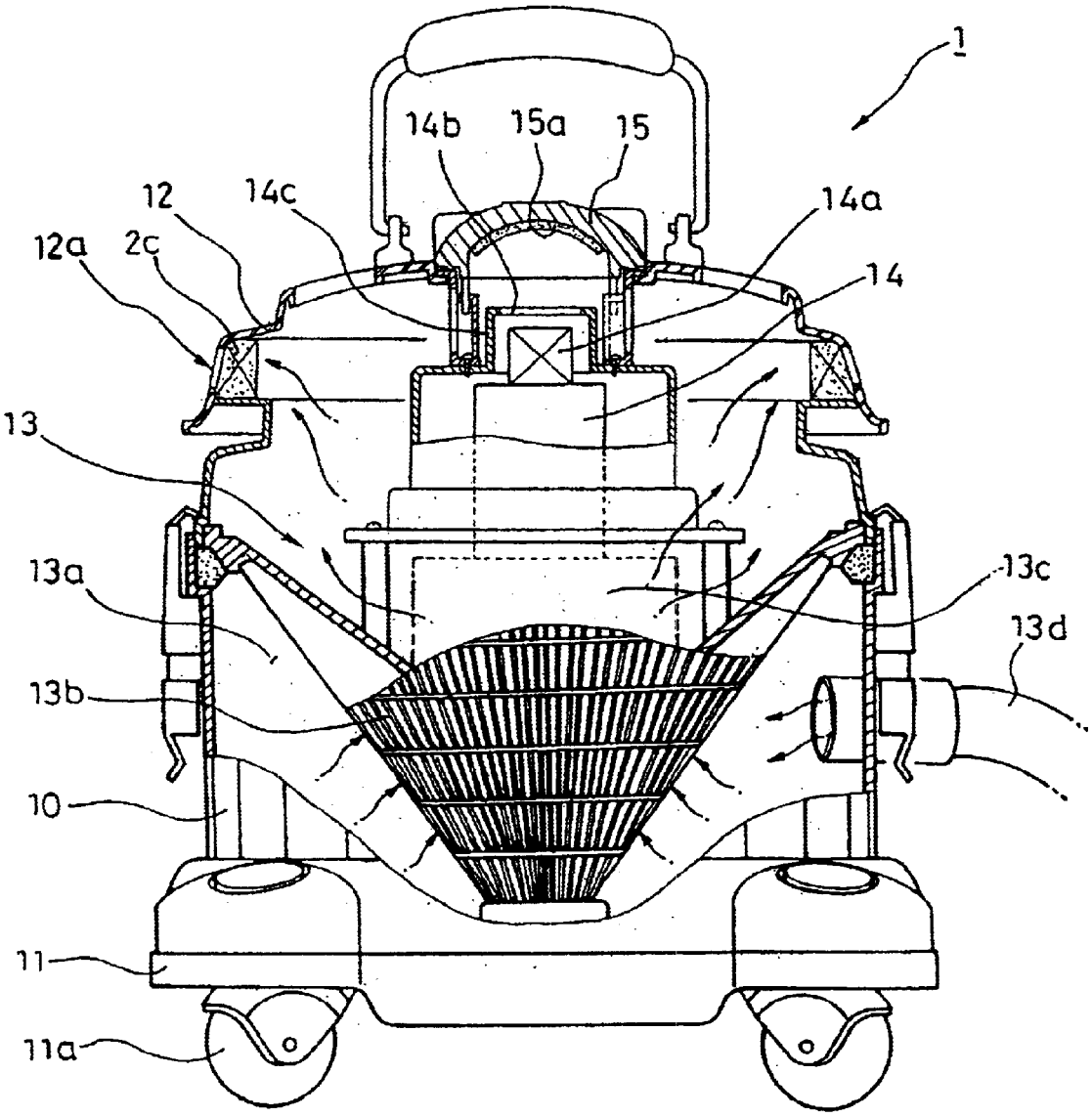
FIG. 1 (PRIOR ART)
FIG. 1 is a partial section view illustrating a conventional vacuum cleaner.
Figure 2:
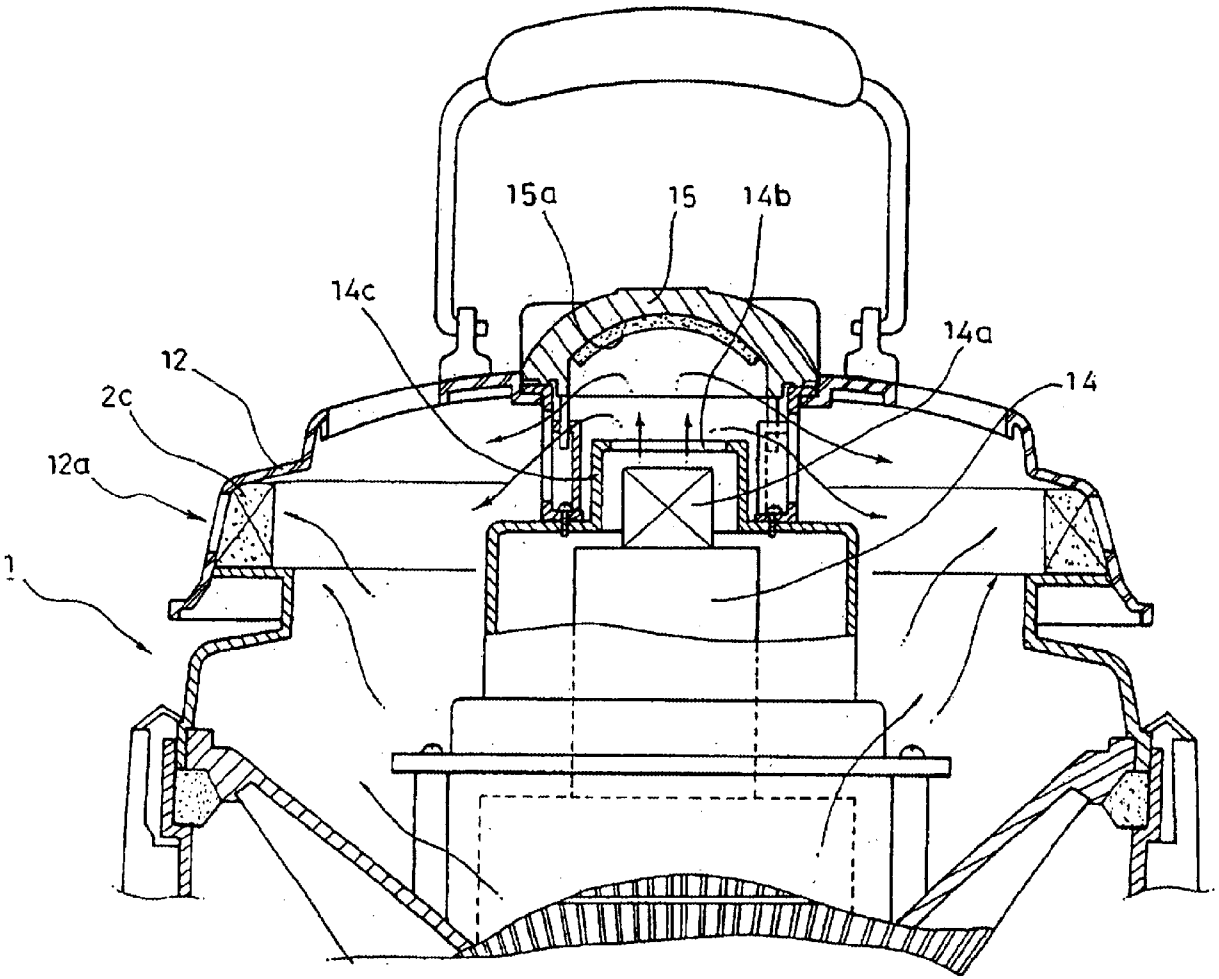
FIG. 2 (PRIOR ART)
FIG. 2 is an enlarged section view illustrating the primary portion of the conventional vacuum cleaner.
Figure 3:
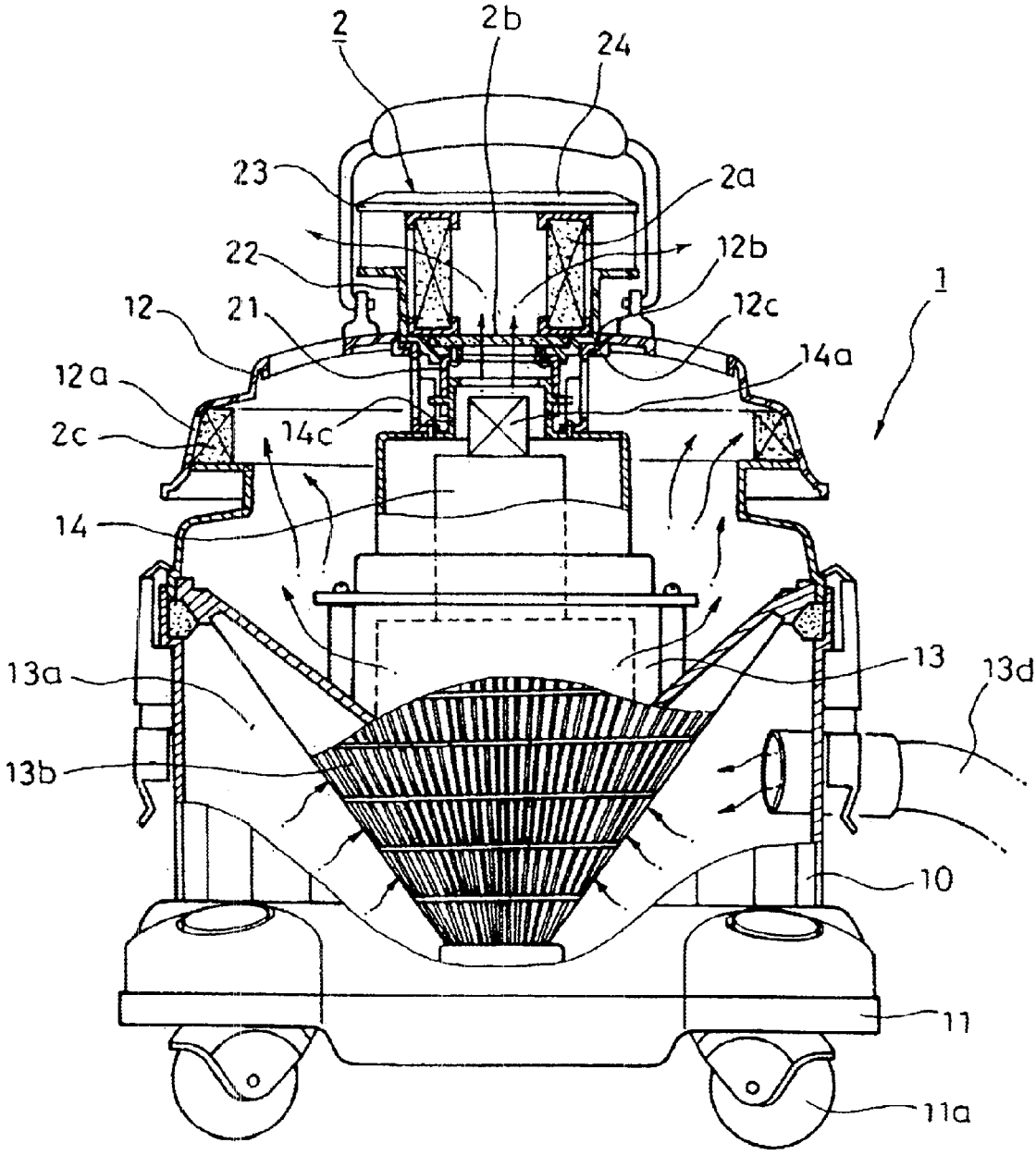
FIG. 3 is a partial section view illustrating a configuration of a vacuum cleaner according to the present invention.
Figure 4:
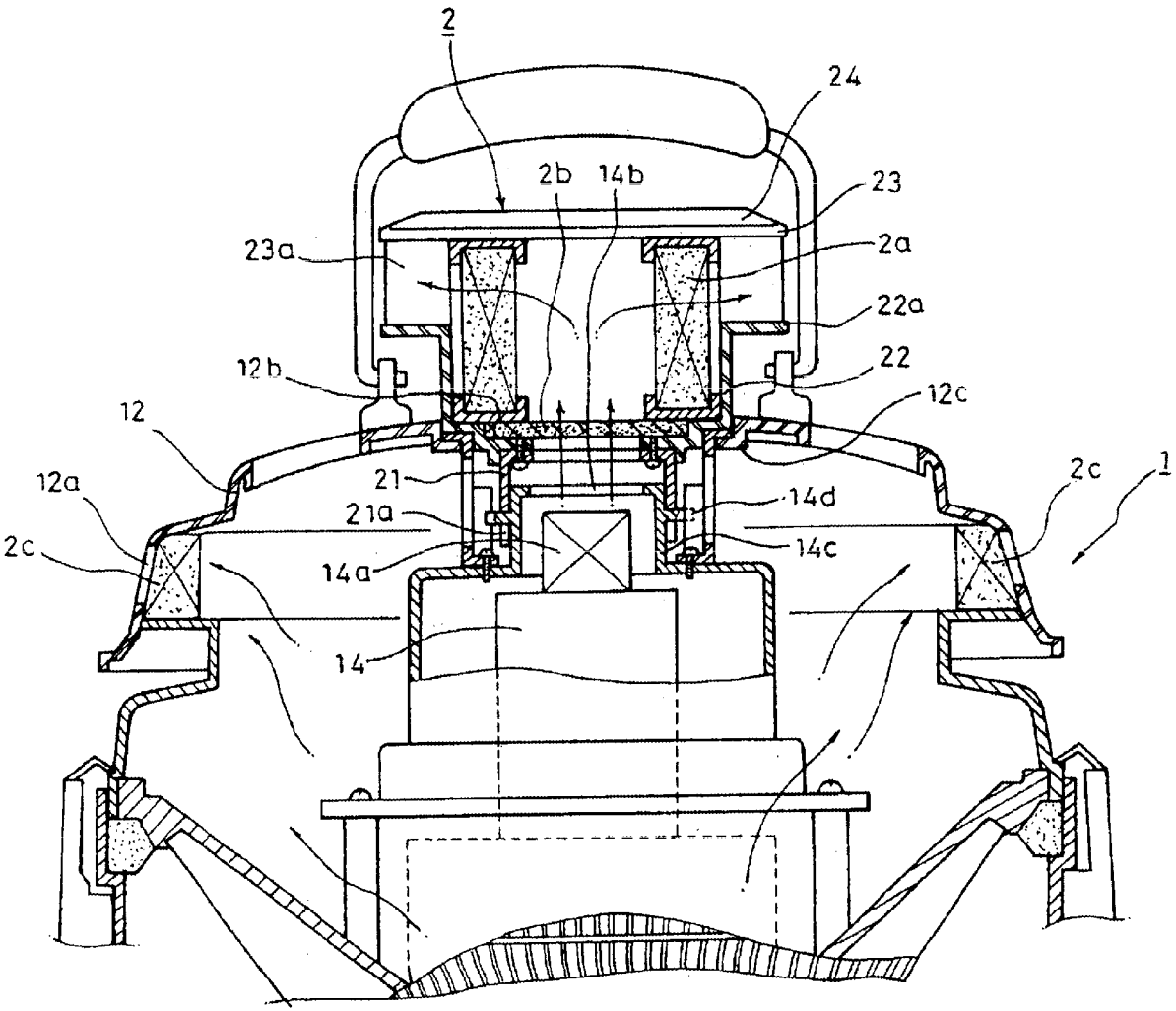
FIG. 4 is an enlarged section view illustrating the primary portion of the vacuum cleaner according to the present invention.
Figure 5:
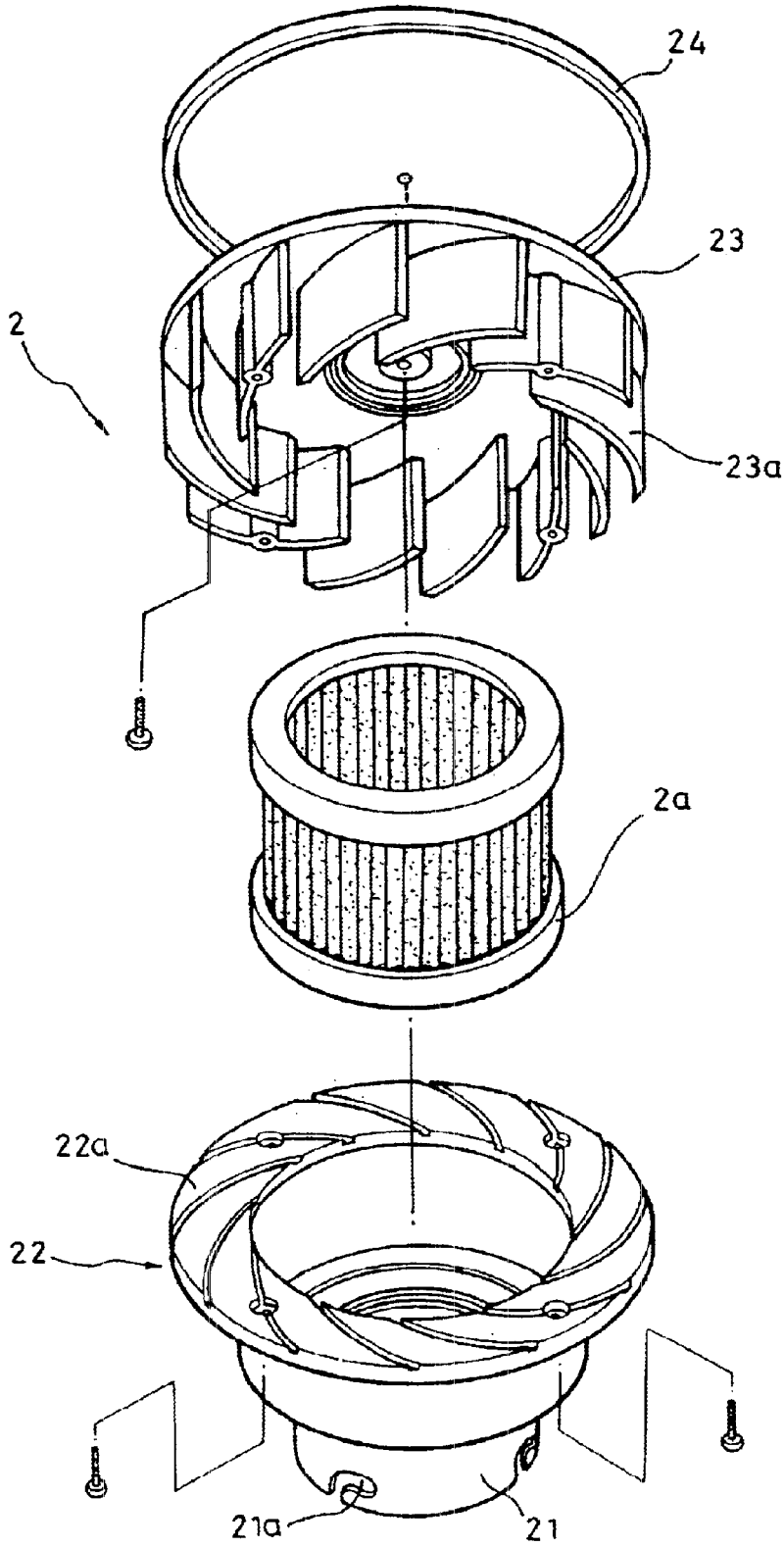
FIG. 5 is a disassembled perspective view illustrating a filter adopted to the present invention.

FIG. 3 is an overall section view of the vacuum cleaner of the present invention, FIG. 4 is a section view thereof, and FIG. 5 is an exploded or disassembled view of the filter unit of the present invention.

Similarly to the conventional machine, the vacuum cleaner of the present invention includes cylindrical canister 10 for having an inner space therein, a supporting member 11 which has wheels 11*a* and which is positioned at a lower portion of canister 10, an air outlet 12*a* arranged at a cover in order to exhaust air from an upper portion of cylindrical canister 10, and a vacuum generating unit 13 containing an electric motor 14 for sucking air into canister 10.

A cover 12 is engaged to an upper portion of the cylindrical canister 10. A circular aperture 12*b* and a circular protrusion or support shelf 12*c* are formed at the center of cover 12, then a filter unit 2 is inserted through aperture 12*b* and engages protrusion 12*c* to rest thereon.

Filter unit 2 has a filter 2*a* in an upper interior portion thereof, and a connection portion 21 at a bottom surface of the filter. When connection portion 21 is connected to a brush assembly case 14*c* of a brush assembly 14*a* in cylindrical canister 10, brush dust exhausted via an air vent 14*b* formed in an upper surface of brush assembly case 14*c* is filtered by filter 2*a* of filter unit 2 and directly discharged.

Filter unit 2 will be explained in more detail with reference to FIG. 5.

Filter unit 2 includes a cylindrical lower case or casing 22 having a flange 22*a*, an upper case or casing 23 having a plurality of spiral blades 23*a* which are arranged radially, a cover 24 on upper case 23, and a connection portion 21 under lower case 22. Filter 2*a* is inserted between upper case 23 and lower case 22.

Connection portion 21 has an inverse L-shaped coupling slot 21*a*, so that a fixation fin 14*d* formed on the brush assembly case of motor case 14*c* is fixed by being inserted into slot 21*a*. Also, an additional filtering member 2*b* is inserted between the center of the interior of lower case 22 and the bottom surface of filter 2*a* for a filtering function enhancement.

The motor brush dust removing filter of the present invention removes brush dust generated by electric motor 14 when power is turned on in order to operate vacuum cleaner 1, and an air suction fan 13*c* rotates in accordance with the driving of electric motor 14, thereby obtaining vacuum suction force required for vacuum cleaning.

In brush assembly 14*a* of electric motor 14, the brush which is adhered closely to a stator abrades the same during a driving of motor 4. Brush dust which is generated by the abrasion of the brush is exhausted to an upper space of vacuum cleaner 1 via air vent 14*b* formed in an upper surface of brush assembly case 14*c*.

In accordance with the present invention, cylinder-shaped connection portion 21 of filter unit 2 directly connects air vent 14*b* and filter unit 2. Therefore, brush dust fed into filter unit 2 by filter 2*a*, and only the purified air is exhausted to the outside or ambient atmosphere.

If filtering member 2*b* is arranged under filter 2*a*, the brush dust is initially filtered by filtering member 2*b* and subsequently filtered by filter 2*a*, thus achieving perfect filtering.

As described above, the motor brush dust removing filter of the present invention is advantageous in that a filter unit is arranged to discharge air through a cover, and heat generated by an electric motor can be directly and easily exhausted. As a result, overheating of the upper portion of the vacuum cleaner can be prevented, and a satisfactory filtering of brush dust is performed, only purified air being exhausted.

What is claimed is:

1. In a vacuum cleaner which includes a cylindrical canister defining an inner space therein, a supporting member having wheels and being connected to a lower portion of the cylindrical canister, a cover engaged to an upper portion of the cylindrical canister, an air outlet installed in the cover for discharging air from the upper portion of the canister, and vacuum generating means including an electrical motor for sucking air from the inner space of the canister, an improved motor brush dust removing filter unit wherein the cover includes, at a center portion thereof, a circular aperture and a circular protrusion formed along said aperture, the vacuum generating means including a motor brush assembly which produces dust during operation of the vacuum generating means, the vacuum generating means further including a case for the motor brush assembly, the motor brush dust removing filter unit having a connection portion inserted into the aperture so that the filter unit rests on the protrusion, the connection portion of the filter unit being connected to the case of the motor brush assembly, the brush dust from the motor brush assembly being vented through an air vent formed in an upper surface of the case of the motor brush assembly and filtered by a filter of the filter unit prior to being exhausted to the outside, for thereby discharging air through the cover and directly and easily exhausting the heat generated by the electrical motor to the outside, so that the upper portion of the vacuum cleaner can be prevented from being over-heated and implementing an effective cooling of the brush assembly and a complete blocking of the brush dust.

2. The motor brush dust removing filter unit defined in claim 1, wherein the filter unit includes a cylindrically shaped lower casing having a flange, a cylindrically shaped upper casing in which spiral blades are radially arranged, the filter, which is inserted between the lower casing and upper casing, a dome-shaped cover fixed to the upper casing, and a connection portion fixed to a lower portion of the lower casing and having an L-shaped coupling slit, whereby the connection portion is connected over the motor brush assembly case.

3. The motor brush dust removing filter unit defined in claim 1, wherein the brush dust removing filter includes an additional filtering member between the cover and an inner center portion of the lower casing for a filtering function enhancement.

4. A vacuum cleaner comprising:

a cylindrical canister defining an inner space therein;

a cover engaged to an upper portion of the cylindrical canister and having, at a center portion thereof, an aperture and a protrusion formed along the aperture;

vacuum generating means including an electrical motor for sucking air from the inner space of the canister, the electrical motor including a brush assembly, the vacuum generating means further including a case disposed about the brush assembly; and a motor brush dust removing filter unit partially inserted through the aperture so that the filter rests at least in part on the protrusion, the filter unit having a connection portion connected to the case of the brush assembly, the case of the brush assembly being formed in an upper surface with an air vent to allow passage of air from the brush assembly case through the filter unit to the outside, thereby enabling a filtering out of dust generated by operation of the brush assembly, for thereby discharging air through the cover and directly and easily exhausting the heat generated by the electrical motor to the outside, so that the upper portion of the vacuum cleaner can be prevented from being overheated and implementing an effective cooling of the brush assembly and a complete blocking of the brush dust.

5. The vacuum cleaner defined in claim 4, wherein the filter unit includes a cylindrically shaped lower casing having a flange, a cylindrically shaped upper casing in which spiral blades are radially arranged, a filter inserted between the lower casing and upper casing, a dome-shaped cover fixed to the upper casing, and a connection portion fixed to a lower portion of the lower casing and having an L-shaped coupling slit, wherein the connection portion is connected over the brush assembly case.

6. The vacuum cleaner of claim 5, wherein the brush dust removing filter includes an additional filtering member between the cover and an inner center portion of the lower casing for a filtering function enhancement.

7. A motor brush dust removing filter unit for use in a vacuum cleaner including (a) a cylindrical canister defining an inner space therein, (b) a cover engaged to an upper portion of the cylindrical canister, a center portion of the cover being formed with an aperture and a protrusion along the aperture, and (c) vacuum generating means including an electrical motor for sucking air from the inner space of the canister, the electrical motor including a brush assembly, the vacuum generating means further including a case disposed about the brush assembly, the motor brush dust removing filter unit having a connection portion inserted into the aperture, the filter engaging the protrusion, the connection portion of the filter unit being connected to the case of the brush assembly, the case of the brush assembly having an upper surface formed with an air vent so that dust generated by action of the brush assembly passes through the air vent and is filtered by a filter of the filter unit prior to being exhausted to the outside.

8. The motor brush dust removing filter unit defined in claim 7, wherein the filter unit includes a cylindrically shaped lower casing having a flange, a cylindrically shaped upper casing in which spiral blades are radially arranged, a filter inserted between the lower casing and upper casing, a dome-shaped cover fixed onto the upper casing, and a connection portion fixed to a lower portion of the lower casing and having an L-shaped coupling slit, wherein the connection portion is connected over the brush assembly case.

9. The motor brush dust removing filter unit defined in claim 8, wherein the brush dust removing filter includes an additional filtering member between the cover and an inner center portion of the lower casing for a filtering function enhancement.

* * * * *